United States Patent [19]

Kerr

[11] 4,110,858

[45] Sep. 5, 1978

[54] LOCK NUT FORMING APPARATUS

[76] Inventor: Jack R. Kerr, 2208 Irving Blvd., Dallas, Tex. 75207

[21] Appl. No.: 824,342

[22] Filed: Aug. 15, 1977

[51] Int. Cl.[2] ..... B21D 53/24; B21K 1/70

[52] U.S. Cl. ..... 10/72 R; 10/86 A; 10/162 A; 10/165

[58] Field of Search ..... 10/72 R, 72 T, 76 R, 10/76 T, 79, 85, 86 A, 162 A, 165

[56] References Cited

U.S. PATENT DOCUMENTS

| | | | |
|---|---|---|---|
| 1,702,320 | 2/1929 | Smith | 10/72 T |
| 2,408,457 | 10/1946 | Tripp | 10/86 A |
| 2,686,546 | 8/1954 | MacLean | 10/86 A |
| 2,859,459 | 11/1958 | Stoll | 10/86 A |
| 3,108,297 | 10/1963 | Tinnerman | 10/72 R |
| 3,171,143 | 3/1965 | Storch et al. | 10/72 R |
| 3,354,926 | 11/1967 | Mattick | 10/86 A |
| 3,486,179 | 12/1969 | Beutler et al. | 10/86 A |

*Primary Examiner*—E. M. Combs
*Attorney, Agent, or Firm*—Peter J. Murphy

[57] ABSTRACT

A heavy duty press mechanism, whose ram is driven by means of an eccentric crank and pitman, carries a head with four aligned indention punches for distorting thread pitch simultaneously on four axially aligned hex nuts. A feed track system feeds a row of axially aligned hex nuts under the punch head. A reciprocating ejector-stop, synchronized with the punch ram, simultaneously ejects a group of four indented nuts and defines a stop for the following group of nuts at the indention station. A feed system includes an axial feed track for feeding nuts to the indention station, a lateral feed track, and a transfer speed coupler coupling these tracks. A vibrating hopper feeds laterally aligned nuts into the lateral feed track, where a single row of side-by-side nuts is fed by gravity to the speed coupler. The speed coupler effects a transfer from lateral feed to axial feed into the axial feed track. Air jet means initiates the axial feed of nuts in the speed coupler; and a vibrator associated with the speed coupler contributes to the smooth, fast transfer of nuts from lateral feed to axial feed. The indention punches deform the material of one wall of each nut, producing accurately controlled thread deflection into the threaded bores, and also produce a controlled, slight ovaloid shape of the hex nut.

12 Claims, 16 Drawing Figures

LOCK NUT FORMING APPARATUS

BACKGROUND AND SUMMARY OF THE INVENTION

This invention relates to apparatus for deforming metal nuts, to provide controlled resistance to turning; and more particularly to automatic apparatus for high speed production of metal lock nuts.

A principal object of this invention is to provide improved high speed production apparatus for metal lock nuts.

Another object of this invention is to provide such improved apparatus including an initial lateral feed of a row of nuts, and novel means for conversion to axial feed of the row of nuts to the deformation head.

A further object of this invention is to provide such improved apparatus which positions accurately a plurality of nuts of a row of nuts under the deformation head for simultaneous deformation.

Still another object of this invention is to provide such improved apparatus including novel nut ejection means.

A still further object of this invention is to provide such improved apparatus including novel means for the handling and thread deforming of acorn nuts.

These objects are accomplished in apparatus which includes a reciprocating ram, having a head carrying at least one indention punch, and means for reciprocating the ram. An axial feed track is provided for guiding axially aligned nuts in a single transverse row under the ram punch, whereby one side wall of the nut is engaged by the indention punch. The axial feed track is disposed for gravity feed of the nuts. An ejector-stop is mounted for reciprocating movement in the plane of the row of nuts under the ram, and transverse to the row. Means is provided for reciprocating the ejector-stop in synchronism with reciprocation of the ram; and the ejector-stop is effective as an ejector to displace at least one lead nut from the row, and is effective simultaneously as a nut stop to stop axial movement of the following nuts in the row. A lateral feed track is disposed for gravity feed of a row of side-by-side nuts to the axial feed track. A feed transfer speed coupler connects the outlet of the lateral feed track and the inlet of the axial feed track, and converts the lateral gravity feed of nuts to axial feed of nuts. A vibrator mounted on the speed coupler vibrates the speed coupler and the axial feed track. Air jet means associated with the speed coupler directs jets of air against one face of the nut in the speed coupler, to urge initial axial feed of the nut into the axial feed track.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 12:
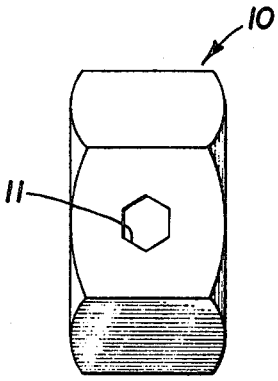
FIGS. 12 and 13 are edge and face views respectively of a typical lock nut formed by apparatus according to the invention.
Figure 13:
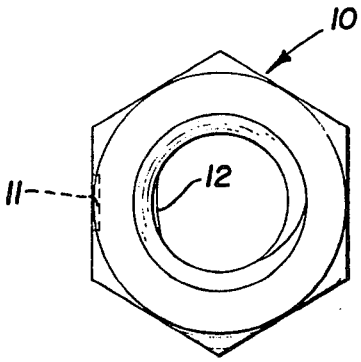

FIGS. 12 and 13 of the drawing illustrate one form of lock nut produced by the apparatus of the invention, this form being a conventional steel, hex nut 10 having two annular end faces and a hexagonal cross-section provided by six side faces. As seen in FIG. 12 a hex-shaped depression 11 has been formed in one side face by a punch head of the press mechanism, this action serving to deform or cause the flow of a portion of the metal at the center of this side face and causing the threads 12 to be deformed into the threaded bore of the nut as seen in FIG. 13. Additionally, this action of the press mechanism will serve to produce a controlled, slightly ovaloid shape of the nut as viewed from one end face, this ovaloid shape improving the effectiveness of the lock nut.

In the forming of lock nuts by a deforming method, certain specifications may be met. One is that the deformed threads 12 must be centered between the end faces, to allow the nut to be hand turned at least one full turn on a mating bolt. Another specification is that the locking feature, or torque resistance feature must be such that the nut can be rethreaded onto a bolt at least five times, while still producing the specified torque resistance.

The apparatus of the invention will also handle acorn nuts as will be described with reference to FIGS. 14 through 16.

Figure 1:
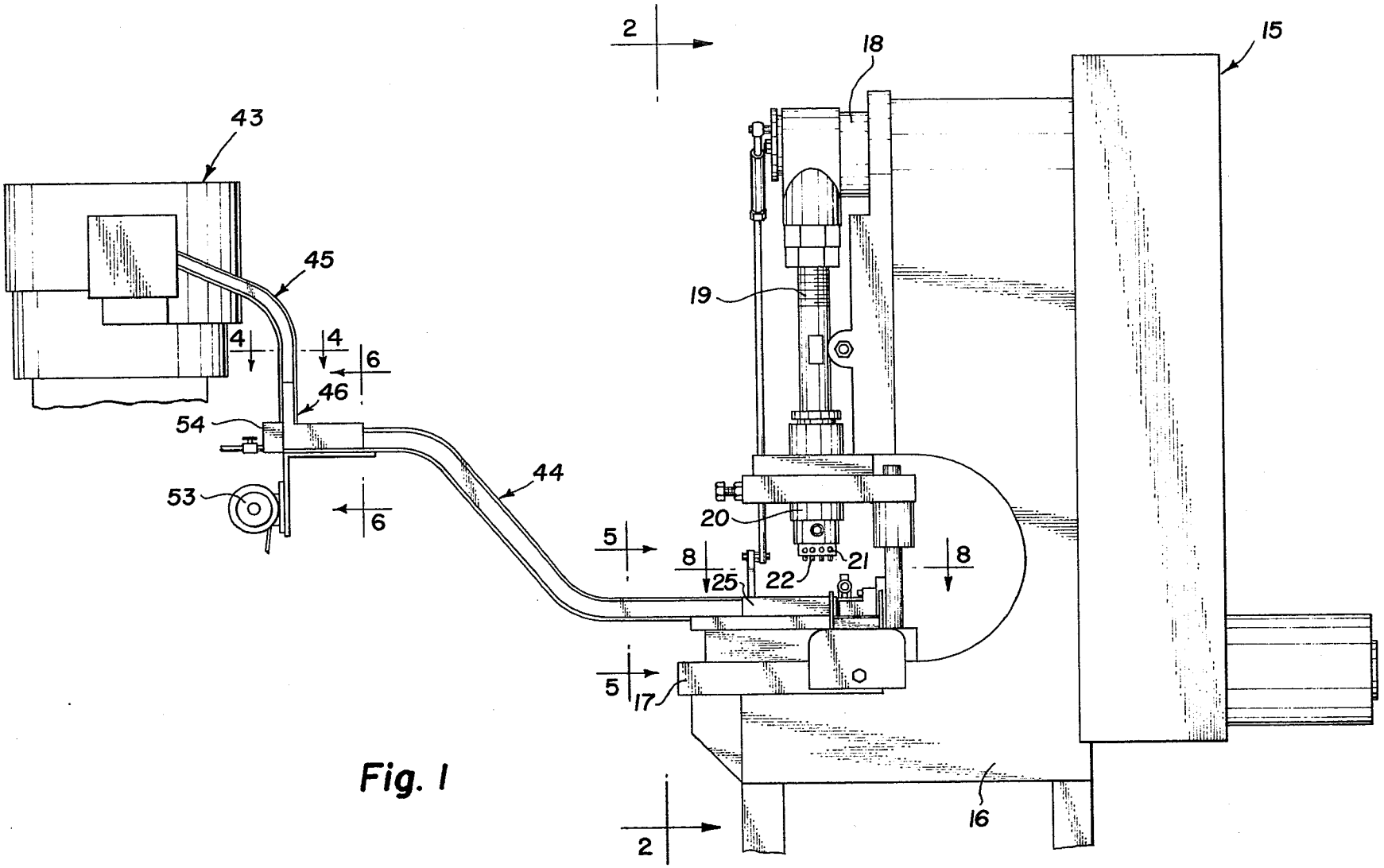
FIG. 1 is a side elevation view of apparatus according to the invention.
Figure 2:
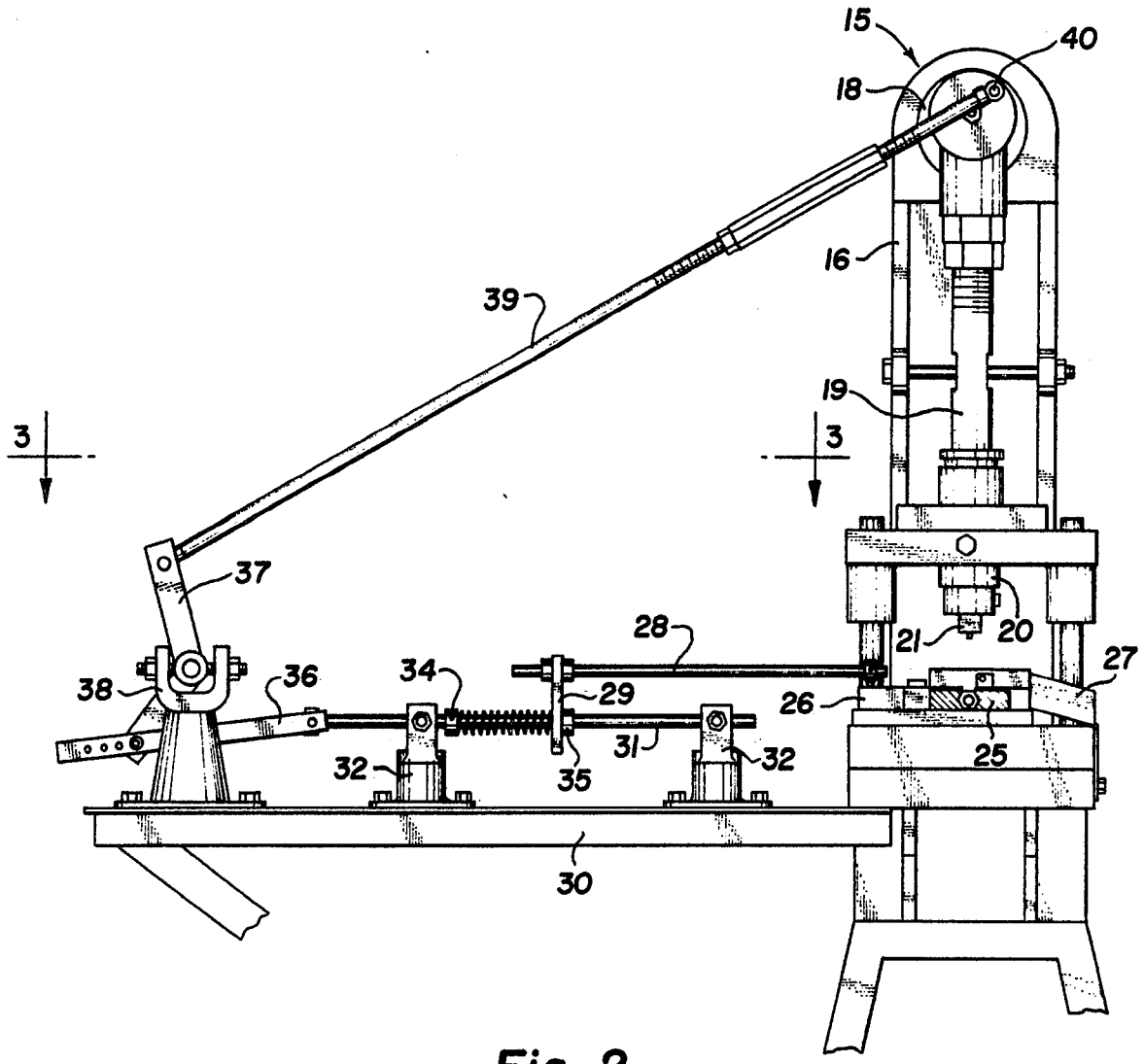
FIG. 2 is a front elevation view of a portion of the apparatus as viewed from the plane 2—2 of FIG. 1.
Figure 3:
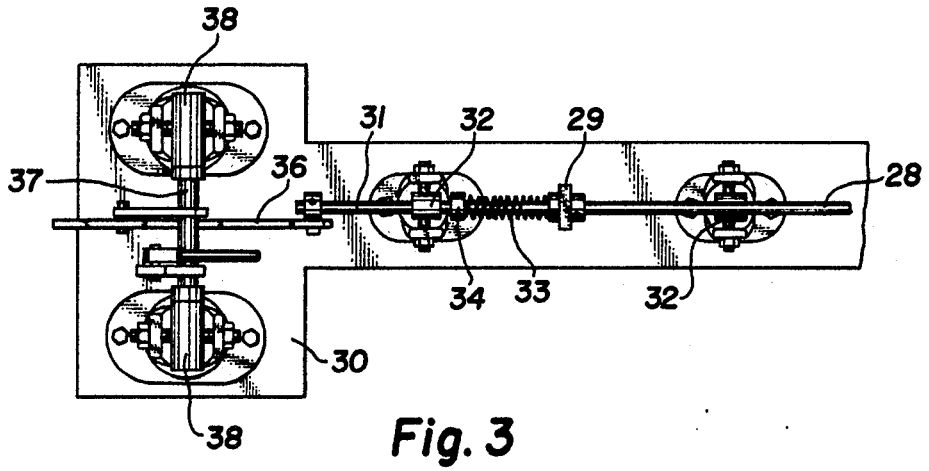
FIG. 3 is a top view of a portion of the apparatus illustrated in FIG. 2, as viewed from the plane 3—3 of FIG. 2.

FIGS. 1, 2 and 3 are general views of one form of apparatus embodying the invention, FIG. 1 being a general side view of the apparatus, FIG. 2 being supplementary and illustrating the front view of the press mechanism and the associated synchronized drive mechanism for the ejector-stop, and FIG. 3 is a further illustration of the drive mechanism for the ejector-stop. The deforming action is accomplished by a conventional heavy duty press mechanism 15 including frame 16 and table 17. An eccentric crank shaft 18 is driven by a suitable flywheel and electric motor (not shown). An adjustable Pitman 19 is coupled to a reciprocating ram 20 through a suitable swivel joint; and a punch head 21 is mounted at the lower end of the ram. In this particular form the punch head carries four individual punches 22 for simultaneously deforming four nuts as will be described.

The nuts are guided in a single row on the press table 17, under the punch head 21, through track defined by side rails 25. An ejector-stop 26 is a slide member, one function of which is to eject the nuts which have been deformed, moving these nuts to a discharge chute 27.

Referring now particularly to FIGS. 2 and 3, the drive mechanism for the ejector slide 26 is supported generally on a support base 30 suitably attached to the frame of the press mechanism 15. A drive rod 31 is supported for reciprocating movement in two pedestal supported linear bearings 32 carried on the base. This drive rod carries a compression spring 33 confined between two collars 34 and 35 fixed on the drive rod 31. The ejector-stop 26 carries an extension shaft 28 disposed parallel to the axis of reciprocation of the ejector stop and also parallel to the drive rod 31; and this extension shaft carries an arm 29 fixed thereon having an aperture to freely receive the drive rod 31; and this arm 29 is confined between the drive rod collar 35 and the spring 33. In normal operation then the ejector-stop 26 reciprocates with the drive rod 31.

The drive rod 31 is coupled by means of a link 36 to a bell crank assembly 37 having a shaft journaled in suitable bearings 38 carried on the base 30. An adjustable actuator arm 39 is connected between the bell crank assembly 37 and an eccentric crank 40 associated with the press mechanism crank shaft 18. It will be seen then that rotation of the eccentric crank 40 reciprocates the ejector-stop 26. It will also be seen that, in the event the ejector-stop is jammed, the spring 33 will allow movement of the drive rod 31 to the right (as viewed in FIG. 2) without accompanying movement of the extension rod 28.

Referring again to FIG. 1, the general arrangement of components for feeding nuts to the press mechanism 15 includes a feed track assembly, supported in fixed relation to the press mechanism 15 consisting of an axial feed track 44, a lateral feed track 45 and a feed transfer speed coupler 46 which couples the axial and lateral feed tracks and effects transfer of nuts from the lateral feed track to the axial feed track. The inlet end of the lateral feed track 45 is disposed adjacent to a vibrating hopper 43, to enable automatic feed of nuts from the vibrating hopper (or other suitable nut hopper) into the lateral feed track. The discharge end of the axial feed track 44 is connected to the press mechanism table 17 in alignment with the nut track defined by the guide rails 25.

Figure 4:
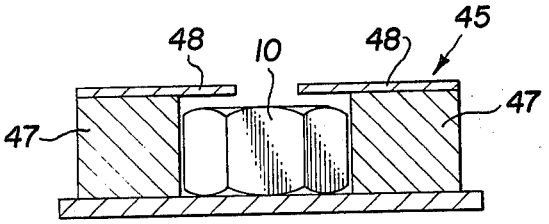
FIG. 4 is a cross-sectional view of the lateral feed track taken in the plane 4—4 of FIG. 1.

It will be seen from FIG. 1 that the nuts are fed partially by gravity in both the lateral feed track 45 and the axial feed track 44. The lateral feed track is so designated since the nuts move in the track in a single row, in lateral or edge-to-edge relation; and the nuts are conveniently fed by the vibrating hopper to the lateral feed track in this orientation. The movement of nuts 10 is illustrated in FIG. 4 wherein the side rails 47 of the lateral feed track are of a width to permit the nuts to abut each other with side faces being contiguous. Retainers 48 allow a slot for visual observation of the movement of nuts through the lateral feed track.

Figure 5:
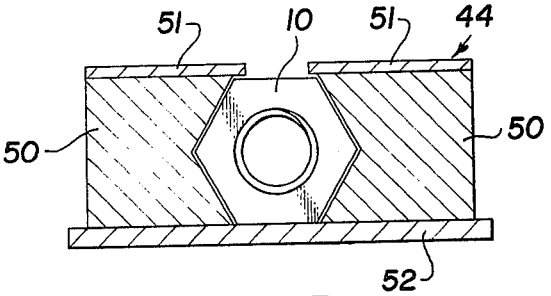
FIG. 5 is a cross-sectional view of the axial feed track taken in the plane 5—5 of FIG. 1.

The axial feed track 44 is so designated since it effects movement of the row of nuts in axial or end-to-end alignment to enable deformation of one side wall of the nut by the punch head. The axial feed track, as seen from the cross-sectional view of FIG. 5, has beveled side rails 50 and retainers 51 for feeding the nuts in specific orientation with one side face contiguous to the track base. The retainers 51 again provide a slot for visual observation of the nut feed, and to enable manual alignment of a nut which may become misaligned.

Figure 6:
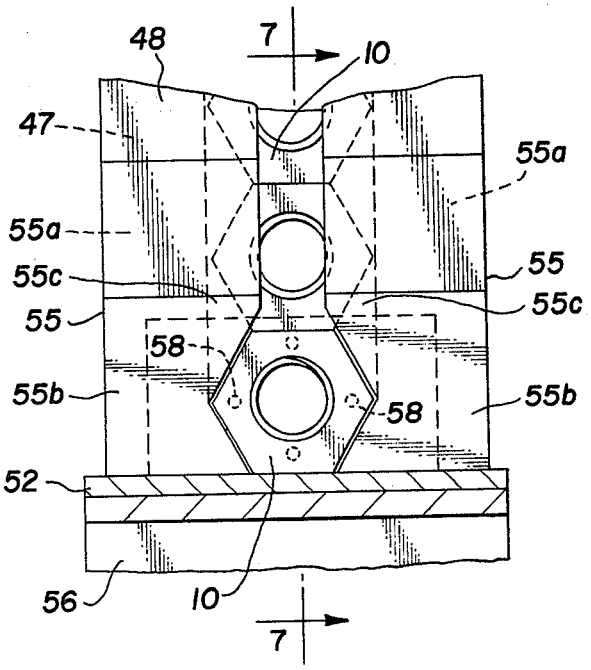
FIG. 6 is a fragmentary elevation view illustrating the track transfer speed coupler, as viewed from the plane 6—6 of FIG. 1.
Figure 7:
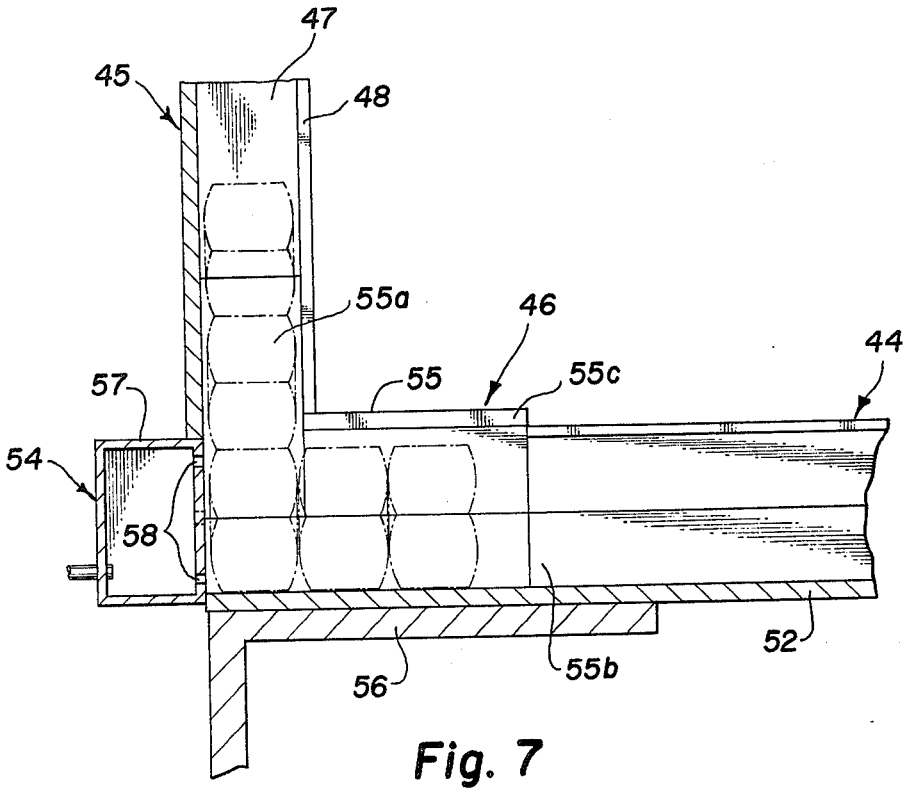
FIG. 7 is a longitudinal sectional view of the track transfer speed coupler, taken in the plane 7—7 of FIG. 6.

The speed coupler 46 functions as a feed booster, and for this purpose it has associated therewith a vibrator 53 and an air jet assembly 54. The speed coupler 46 is particularly illustrated in FIGS. 6 and 7 and includes generally L-shaped side members 55 including vertical portions 55*a* defining side rails which align with the side rails 47 of the lateral feed track, and horizontal portions 55*b* defining side rails which align with the side rails 50 of the axial feed track 44. The side rail portions 55*b* provide lower and upper beveled surfaces for confining the hex side faces of the nut; and the upper beveled surfaces are provided by lips 55*c*.

The base of the speed coupler is formed by the base plate 52 of the axial feed track; and the vibrator 53 is secured to this base plate by means of a suitable bracket 56. The vibrator 53 may be any suitable electrically, mechanically, or air operated vibrator, preferably an adjustable vibrator.

The air jet assembly 54 consists of an air box or manifold 57 which forms a portion of the back wall of the speed coupler, in alignment with the axial feed track, and which is connected to a source of pressurized air. An adjustable inlet valve controls the flow of air into the manifold 57. The inner wall of the manifold 57 has four airholes or ports 58 which are disposed to direct air into the speed coupler and to impinge on one end face of a hex nut positioned at the bottom of the speed coupler at best seen in FIG. 6. Preferably these air ports are disposed to be generally equally spaced around the periphery of the nut end face. The jets of air emitting from the ports 58 impinge against the nuts to move the nuts axially toward the axial feed track 44.

The feed of the nuts 10 from the hopper 43 to the press mechanism 15 occurs generally as follows. The nuts move laterally from a hopper into the generally horizontal portion of the lateral feed track 45, with the lateral feed track curving downward generally vertically so that the nuts continue movement by gravity feed in the lateral feed track to the speed coupler 46. During this movement of nuts, encouraged by the vibrator 53, the nuts will follow each other with flat side faces generally contiguous. The lowermost nut in the lateral feed track is resting in the speed coupler in the position seen in FIG. 6. Assuming space is available for the nut to move axially to the right, as viewed in FIG. 7, this movement will be urged initially by the air jets from the jet ports 58 and continued movement will be encouraged by the vibrator 53. The axial feed track 44 includes an inclined portion of substantial length to produce gravity feed of the nuts flowing axially from the speed coupler 46 to the press. The discharge end of the axial feed track is horizontal and merges with the track defined by the side rails 25 of the press mechanism table. As seen in FIG. 2 these side rails are configured to correspond generally to the side rails 50 of the axial feed track. The gravity feed of the nuts in the axial feed track will maintain the necessary supply of nuts under the multiple punch head and against the stops to be described. The feed booster components, namely the vibrator 53 and the air jet assembly 54 assure the rapid flow of nuts from the lateral feed track to the axial feed track.

Figure 8:
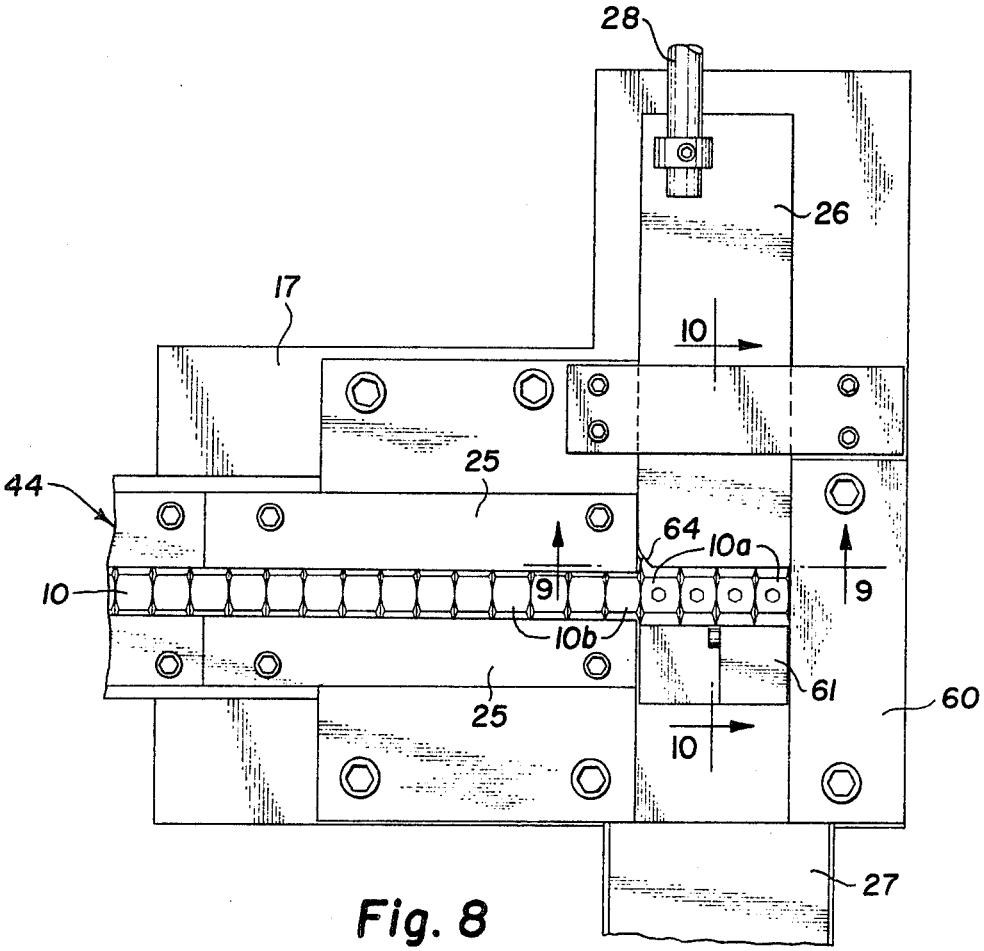
FIG. 8 is a fragmentary plan view of a portion of the apparatus as viewed from the plane 8—8 of FIG. 1.
Figure 9:
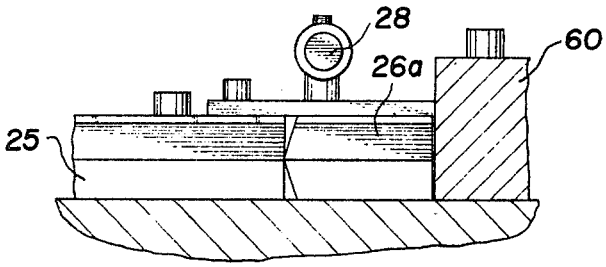
FIG. 9 is a fragmentary sectional view, taken in the plane 9—9 of FIG. 8.
Figure 10:
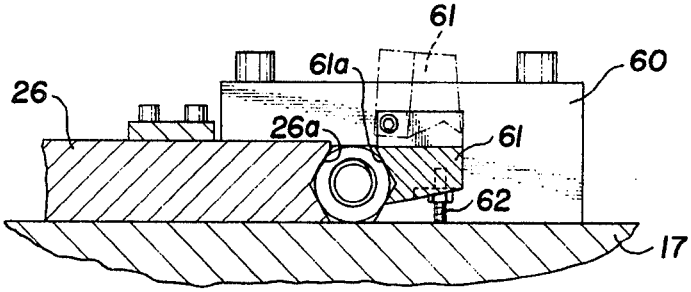
FIG. 10 is a fragmentary sectional view taken in the plane 10—10 of FIG. 8.
Figure 11:
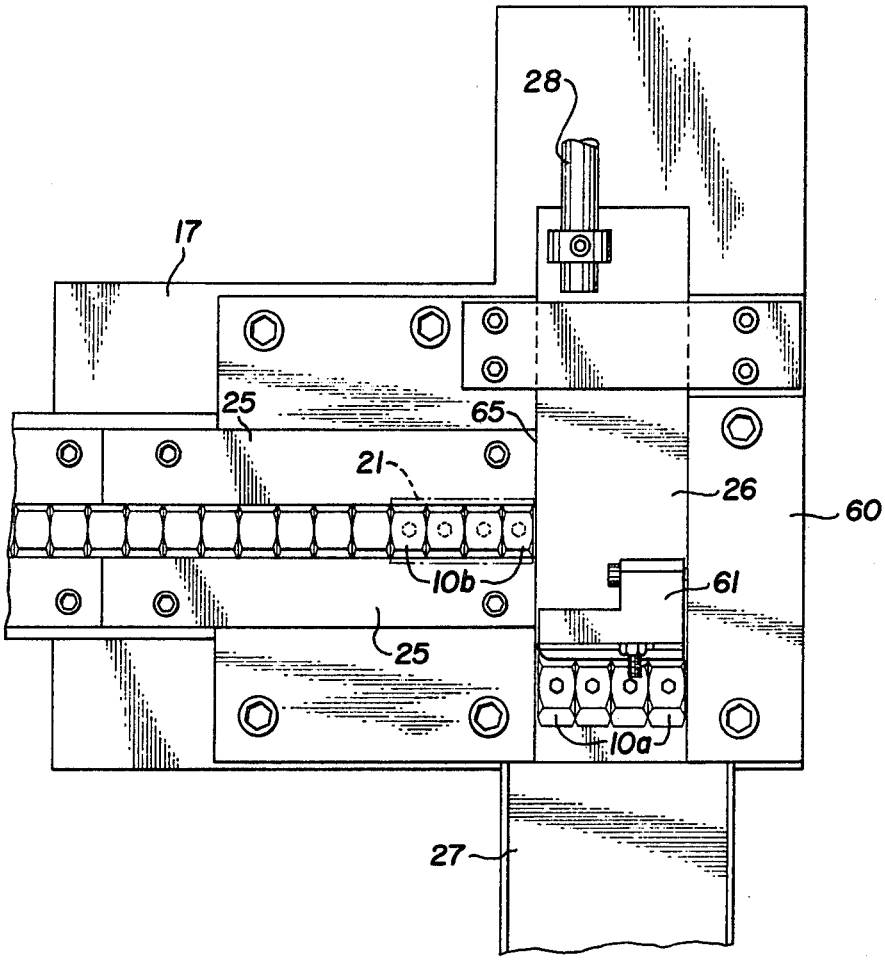
FIG. 11 is a fragmentary plan view, similar to FIG. 8, illustrating a different phase of the operation of the apparatus.

Referring now to FIGS. 8 through 11, the operation of the ejector-stop and its coaction with the punch head will be described. FIG. 8 illustrates the movement of a row of nuts 10 from the axial feed track through the table track 25 to the stops. As seen in FIG. 8, the ejector slide is in the retract or guide position, and the lead group of four nuts 10*a* has moved across the face of the ejector slide against a stop bar 60 fixed to the press table. To assist in guiding the lead group of nuts 10*a* to this position, the leading face of the ejector slide 26 is provided with lower and upper beveled faces which corresponds to the beveled faces of the side rails 25 and of the side rails 50 of the axial feed track. This end face 26*a* is aligned with its associated side rail 25 in this position. To further guide the lead group of nuts 10*a* into this eject position, a guide member 61 is pivotally mounted on the stop wall 60, about a horizontal axis. This guide member 61 includes a beveled face 61*a* confronting the ejector stop face 26*a* to further guide these nuts into the eject position and to prevent these nuts from either riding up or riding outward from the ejector face under the force of the gravity feed. The guide 61 includes an adjustable stop leg 62 to limit the downward movement of the guide to the guide position. This guide is pivotally mounted to enable movement out of the way (to the phantom line position in FIG. 10) when the ejector stop moves to the eject position.

Referring again to FIG. 8, it will be seen that the ejector stop 26 is positioned to displace the lead group of nuts 10*a* to the chute 27. Since the width of the ejector-stop must be at least the width of the maximum width of the lead group of four nuts, it is likely that because of tolerances the total width of the lead group of nuts will be somewhat less; and accordingly, the lead nut of the following group of nuts 10*b* will likely project into the path of the ejector-stop. The ejector-stop is provided with a beveled camming surface 64 to displace the nuts somewhat to the left, if necessary, as the ejector stop begins its ejection stroke. When this ejector stroke begins, the movement of the nut against the guide 61 will simply pivot the guide up and out of the way. During the ejection stroke, the face 65 of the ejector-stop, which confronts the axial feed track, functions as a stop face for the group of four nuts 10*b* which now becomes the lead group; and this stop face 65 fixes the position of this lead group of nuts to be engaged by the punches 22 of the punch head 21 as indicated in phantom lines in FIG. 11. Preferably the synchronized timing will be such that the ejector stop 26 will be completing its ejection stroke, and therefore will be substantially stationery, at the same time that the punch press ram is completing its punching stroke. When the ejector-stop retreats to the guide position, the guide 61 will drop down to its guide position, and the lead group of nuts 10*b* will then move into the path of the ejector-stop.

EMBODIMENT OF FIGURES 14, 15 AND 16

Figure 15:
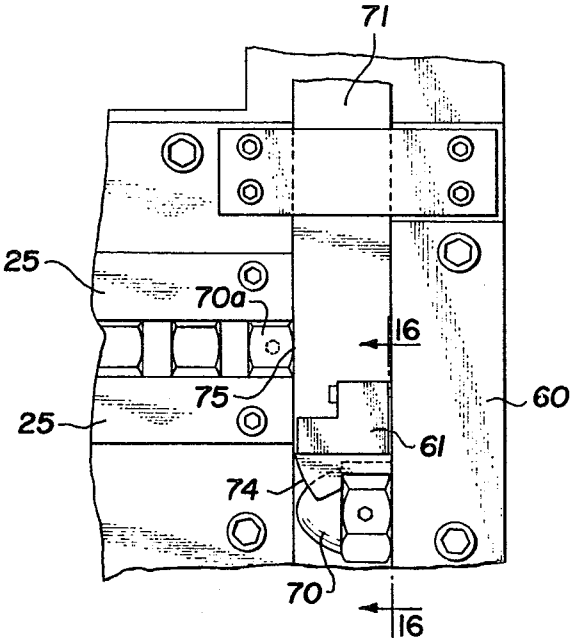
FIG. 15 is a fragmentary plan view similar to FIG. 14 illustrating a different phase of the operation of the apparatus of FIG. 14.
Figure 16:
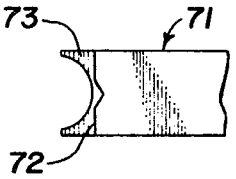
FIG. 16 is a fragmentary detail view of the nut ejector as viewed from the plane 16—16 of FIG. 15.
Figure 14:
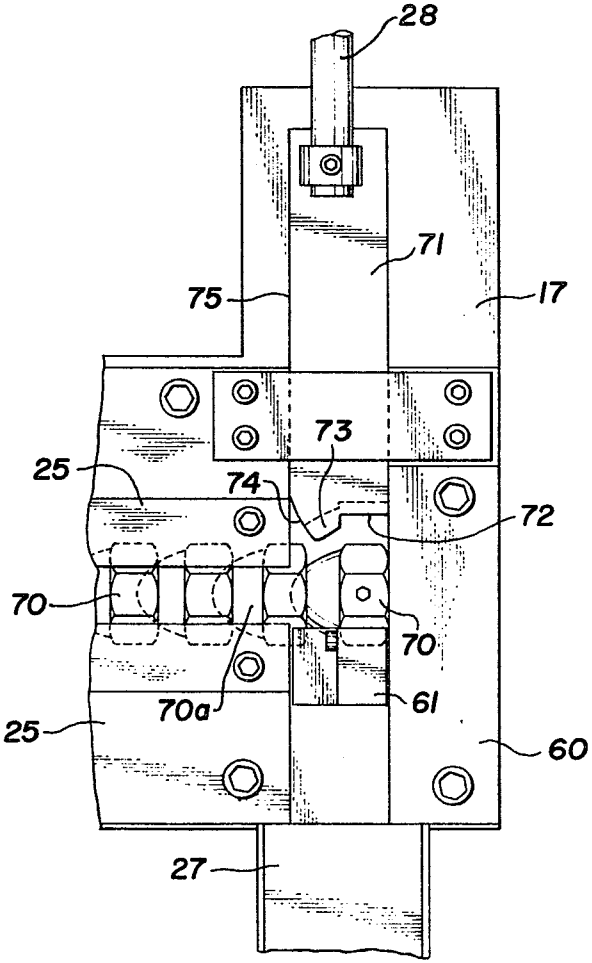
FIG. 14 is a fragmentary plan view, similar to FIG. 8, illustrating a modified form of apparatus according to the invention for handling acorn nuts.

FIGS. 14, 15 and 16 illustrate a modified form of ejector-stop for use in the apparatus of the invention for the handling of acorn nuts 70. In the following discussion, the modified ejector slide is designated 71; and the remaining parts of the apparatus bear the same reference numbers as discussed above.

The handling of acorn nuts presents particular problems, since the domed crown projecting from one face of these nuts extends into the threaded recess in the opposite face as indicated by the nuts shown in both solid and phantom lines in FIG. 14. This means that some special care must be taken to separate the lead nut in the eject position from the following nuts, at the beginning of the ejection stroke of the ejector-stop 71. In this modified form of apparatus, only a single nut 70 is punched, and a single nut ejected during each cycle of the apparatus.

As seen in the drawings, the leading edge of the ejector-stop 71 is provided with a specially designed face for coacting with the acorn nut 70. This face includes a beveled shoulder portion 72 for engaging the hex portion of the acorn nut, and a lip portion 73 for engaging the crown of the nut. The lip portion 73 incorporates a specially designed beveled camming face 74 for engaging the leading face of the following nut 70*a*.

Because of the above mentioned interlocking of the nuts fed in an axial row, the following nut 70*a* extends significantly into the path of the ejector-stop 71, as seen in FIG. 14, when the ejector-stop is in a retract position. The special design of the ejector stop enables the camming of the following nut 70*a* back to a position of alignment in the plane of the ejector-stop stop surface 75 with minimum cocking of the following nut 70*a*. The parts are arranged so that the following nut 70*a* will be cammed axially rearward by both the crown of the lead nut 70 and the camming surface 74 of the ejector-stop; and the following nut will then be maintained in the desired position against the stop surface 75 for engagement by the punch of the punch head 22. For this purpose the leading end face is designed to engage both the hex and the crown of the lead acorn nut to prevent cocking of this nut which would distort the above camming action on the following nut. The length of the ejector-stop stop face 75 is such that the following nut 70*a* is fully seated against the stop face 75 at the moment of engagement by the punch. This is necessary to assure proper location of the deformation recess on the hex wall of the nut.

What has been described is a unique form of apparatus for the fully automatic, or substantially fully automatic, high speed handling and indenting of nuts to provide lock nuts by deformation of the nut body. The high speed or high production capability of the apparatus results from a combination of several basic functions: namely the employment of multiple indention punches in a common punch head, the automatic feed system which maintains an adequate supply of nuts at the indention station, and the ejection mechanism coacting with the punch head for ejecting the finished nuts at an appropriate rate.

An important feature of the invention is the feed system, particularly the speed coupler which accomplishes the rapid transfer of the nuts from the lateral feed track to the axial feed track. This is particularly important since, in practical operation, an effective vibrating hopper feeds the nuts laterally or in side-by-side relation, while the indention station requires axial feed as has been described. The described speed coupler has the capability to transfer nuts from the lateral feed track to the axial feed track at a much higher rate than is required at the indention station; and this is desirable so that the speed coupler can catch up with the indention station requirements, following a momentary jam either in the axial feed track or at the vibrating hopper, for example.

Another important feature of the apparatus is the provision of an ejector-stop driven in synchronization with the punch ram, wherein the ejector-stop functions to eject a lead group of nuts while simultaneously functioning as the positioning stop for the following group of nuts during the punch stroke, thereby enabling accelerated handling of a large quantity of nuts.

Still another important feature of the invention is its ability to handle special forms of nuts such as acorn nuts.

While preferred embodiments of the invention have been illustrated and described, it will be understood by those skilled in the art that changes and modifications may be resorted to without departing from the spirit and scope of the invention.

What is claimed is:

1. Apparatus for forming lock nuts comprising a reciprocating ram; a head on said ram carrying at least one punch; means for reciprocating said ram;

an axial feed track for guiding axially aligned nuts in a single transverse row under said ram punch, whereby one side wall of a nut is engaged by said punch; said axial feed track being disposed for gravity feed of the nuts;

an ejector-stop mounted for reciprocating movement, in the plane of said row of nuts, under said ram and transverse to said row; means for reciprocating said ejector-stop in synchronism with the reciprocation of said ram; said ejector-stop being effective as an ejector to displace at least one lead nut from said row, and being effective simultaneously as a nut stop to stop axial movement of the following nuts in said row;

a lateral feed track disposed for gravity feed of a row of side-by-side nuts to said axial feed track;

a feed transfer speed coupler connecting the outlet of said lateral feed track and the inlet of said axial feed track; said speed coupler converting the lateral gravity feed of nuts to axial feed of nuts; a vibrator mounted for vibrating said speed coupler and said axial feed track; and air jet means associated with said speed coupler for directing jets of air against one face of a nut therein to urge initial axial feed of the nut into said axial feed track.

2. Apparatus as set forth in claim 1 said axial feed track including an inclined portion to induce gravity feed of nuts therein; and said lateral feed track including a generally vertical portion adjacent to said speed coupler.

3. Apparatus as set forth in claim 1 a vibrating hopper mounted in association with said lateral feed track, having means for feeding and directing laterally oriented nuts into said lateral feed track.

4. Apparatus as set forth in claim 1 said speed coupler comprising confronting L-shaped side members, defining side rails for the outlet end of said lateral feed track and side rails for the inlet end of said axial feed track; said side rails for said axial feed track including confronting faces having lower and upper beveled portions configured for guiding hex nuts.

5. Apparatus as set forth in claim 1 said vibrator including adjustable control means for varying the vibrations; and said air jet means including adjustable means for controlling said jets of air.

6. Apparatus as set forth in claim 1 said air jet means comprising air chamber means mounted to form a wall of said speed coupler axially confronting said axial feed track; means for connecting said air chamber means to a source of pressurized air; air ports in said wall for directing said air jets against a nut.

7. Apparatus as set forth in claim 1 said ejector-stop being reciprocable between a guide position and an eject position; the leading edge of said ejector slide defining, in said guide position a guide wall for said row of nuts which is a continuation of one wall of said axial feed track.

8. Apparatus as set forth in claim 7 one side wall of said ejector-stop functioning as said nut stop; the leading edge of said nut stop side wall defining a cam surface for urging the following nuts slightly rearward to the plane of said nut stop side wall.

9. Apparatus as set forth in claim 7 a guide, pivotally mounted about an axis parallel to said row of nuts, defining a guide wall confronting said ejector-stop guide wall, and disposed as a continuation of the other side wall of said axial feed track; said guide member being disposed to be pivoted out of the path of said at least one lead nut and said ejector-stop, when said ejector-stop displaces said at least one lead nut from said row.

10. Apparatus as set forth in claim 1 said ejector-stop having a leading edge face configured for engagement with an acorn nut; said edge face having a shoulder for engaging the hex portion of an acorn nut, and having an adjacent lip for engaging simultaneously the crown portion of an acorn nut.

11. Apparatus as set forth in claim 10 one side wall of said ejector-stop functioning as said nut stop; the leading edge of said nut stop side wall coinciding with said lip, and defining a cam surface for urging the following acorn nut slightly rearward to the plane of said nut stop wall.

12. Apparatus as set forth in claim 1 said means for reciprocating said ram comprising eccentric crank means; means for reciprocating said ejector-stop comprising an actuator arm coupled to said eccentric crank means, a bell crank assembly oscillated by said actuator arm, a drive rod coupled to said bell crank; an extension rod fixed to said ejector-stop and carrying a follower arm; and spring means coupling said drive rod and said follower arm defining a yieldable drive for said extension rod in one direction of reciprocation.

* * * * *